US005530521A

United States Patent [19]

Lee

[11] Patent Number: 5,530,521

[45] Date of Patent: Jun. 25, 1996

[54] APPARATUS AND METHOD FOR SENSING STATE OF A WASTE TONER BOX OF SYSTEM IN AN ELECTROPHOTOGRAPHIC REPRODUCTION APPARATUS

[75] Inventor: Myeong-Soo Lee, Kyungki-do, Rep. of Korea

[73] Assignee: SamSung Electronics Co., Ltd., Kyungki-do, Rep. of Korea

[21] Appl. No.: 249,130

[22] Filed: May 24, 1994

[30] Foreign Application Priority Data

May 24, 1993 [KR] Rep. of Korea ..... 1993-8990

[51] Int. Cl.[6] ..... G03G 21/10

[52] U.S. Cl. ..... 355/206; 355/298

[58] Field of Search ..... 355/298, 260, 355/206; 340/612

[56] References Cited

U.S. PATENT DOCUMENTS

| | | | |
|---|---|---|---|
| 3,233,781 | 2/1966 | Grubbs . | |
| 3,804,512 | 4/1974 | Komori et al. . | |
| 3,949,234 | 4/1976 | Vadermark . | |
| 4,099,861 | 7/1978 | Abel . | |
| 4,500,196 | 2/1985 | Shimura | 355/298 X |
| 4,501,484 | 2/1985 | Shimura . | |
| 4,601,082 | 7/1986 | Kurz . | |
| 4,630,653 | 12/1986 | Kan . | |
| 4,711,561 | 12/1987 | Tsuruoka . | |
| 4,730,205 | 3/1988 | Ogiri et al. . | |
| 4,745,440 | 5/1988 | Kono et al. | 355/298 X |
| 4,768,055 | 8/1988 | Takamatsu et al. . | |
| 4,801,980 | 1/1989 | Arai et al. . | |
| 4,868,599 | 9/1989 | Niki . | |
| 4,982,231 | 1/1991 | Matsuuchi | 355/206 |
| 5,153,649 | 10/1992 | Park . | |
| 5,260,755 | 11/1993 | Imaizumi | 355/298 |
| 5,276,481 | 1/1994 | Kinoshita et al. . | |

*Primary Examiner*—Neston R. Ramirez
*Attorney, Agent, or Firm*—Robert E. Bushnell

[57] ABSTRACT

A method and apparatus for sensing state of a waste toner box of a system during an electrophotographic developing process. The apparatus and method sense whether or not a waste toner receptacle has been installed prior to initiation of the development process and whether the receptacle is full of waste toner. The receptacle has a semi-transparent body for storing a waste toner removed from a cleaning blade, a photosensor for generating a signal representing whether the waste toner stored in the waste toner receptacle has substantial filled the receptacle as well as whether the waste toner receptacle has been installed. A light emitting unit and a light receiving unit are respectively installed on opposite sides of the receptacle from each other, facing the waste toner receptacle, to sense whether or not the waste toner receptacle has been installed and whether the receptacle is full, a controller for receiving the signal from the photosensor, for determining the presence or absence of the waste toner box and whether the receptacle is full of the waste toner, and for generating respective control signals corresponding to the states of the waste toner receptacle and the waste toner within the receptacle, and a visual display providing a message indicating the presence or absence of the waste toner receptacle, and whether the receptacle is full of waste toner, or whether a normal state exists, on the basis of the respective control signals from the controller.

24 Claims, 3 Drawing Sheets

APPARATUS AND METHOD FOR SENSING STATE OF A WASTE TONER BOX OF SYSTEM IN AN ELECTROPHOTOGRAPHIC REPRODUCTION APPARATUS

CROSS REFERENCE TO RELATED APPLICATIONS

This application makes reference to, incorporates herein and claims all benefits accruing under 35 U.S.C. §119 from my application earlier filed in the Korean Industrial Property Office on May 24, 1993 entitled *An Apparatus And Method For Sensing State Of A Waste Toner Box Of System Using An Electrophotographic Developing Process*, and duly assigned Serial No. 8990/1993.

BACKGROUND OF THE INVENTION

The present invention relates to a method for sensing the status of a waste toner receptacle in a system of an electrophotographic reproduction process and apparatus and, more particularly, to an apparatus and method for sensing whether a waste toner receptacle has been installed in the apparatus and whether the receptacle is full of waste toner.

In general, a system using an electrophotographic process is provided with a container such as a waste toner box for receiving and storing waste toner remaining after the toner formed on a photosensitive drum has been transferred to a printable medium such as a sheet of paper.

As far as a conventional method for sensing whether or not the waste toner box is installed and the waste toner is in a full state is concerted, the amount of the waste toner stored in the waste toner box has been sensed by operation of depressing a sensor due to downward pressure due to the mass of the toner, or by using a photosensor as, for example, shown by the *Contamination Sensor* by F. B. Abel, U.S. Pat. No. 4,099,861, or the *Photoconductive Element Cleaning Apparatus And Residual Toner Collecting Apparatus*, by Akira Shimura, U.S. Pat. No. 4,501,484, or the *Toner Collecting Apparatus* by Tadakazu Ogiri, et al, U.S. Pat. No. 4,730,205. In those prior designs that rely upon mechanical actuation of switches to detect whether the waste toner box is installed as, for example, the movement of a contact lever is sensed by using a contact sensor when the waste toner box is inserted into a system, and to determine whether the waste toner box is full, the need to accommodate the movements of the mechanical components hinders a consumer preference for compactedness in the overall size of the end unit product.

Alternatively, other prior designs rely upon the movement of a lever operating a mechanical actuator to determine whether the waste toner box has been inserted into the developer, and then after the waste toner box is determined to have been installed, light is transmitted from the light emitting unit to the light receiving unit while using the photosensor to detect the condition of waste toner within the receptacle. Such designs rely upon both mechanical and photo-optic sensors, and thus unnecessarily increase the cost of the end unit product, as well as create an additional source of equipment malfunction.

In those designs relying upon photosensors, when light is emitted from a light emitting unit and the waste toner box is not full of waste toner, the light is transmitted to a light receiving unit; if the waste toner box is full however, the light is not transmitted to the light receiving unit. Placement of the photosensors is critical however. In the design of the earlier mentioned Ogiri '205, for example, effort was made to avoid false signals due to scattering of waste toner upon entry into the waste toner box, and the photosensor is located at an uppermost region of the waste toner box while a toner feeding member is rotatably driven along a lower end edge of a toner receiving; port cut into the side of the waste toner box. The design of Ogiri '205 is flawed however, as is noted in the commentary (ostensibly directed however, to Shimura '484) of the *Toner Recovery Device* by Ryoichi Tsuruoka, in U.S. Pat. No. 4,711,561, because if the power of the toner feeding member introducing waste toner into the side port of the waste toner box is insufficient to push the recovered toner up to the height corresponding to the light path between the photosensors mounted above the waste toner box, "the detection of a toner fill condition will be unreliable.38 Tsuruoka '561 itself however, also uses a side fed waste toner box, but relies upon a vertical fin of a float riding upon waste toner introduced through the side port, to interrupt light transmission along the path, and seems not to address the risk that scattering of waste toner could bury the float within the waste toner box, and thus prevent generation of a toner full signal. Moreover, I have observed that designs following either Ogiri '205 or Tsuruoka '561 essentially equate an unobstructed light transmission path to a normal condition, and make no provision for detecting the absence of the waste toner box, a flaw that absent a mechanically actuated sensor, could result in introduction of waste toner throughout the interior of the end unit product.

Shimura '484 provides in one embodiment, a spring-loaded, light interception plate to block the light transmission path between a light emitting element and a light receiving element while the waste toner container is removed. I have noticed that the photosensor is therefore unable to distinguish between a condition where the waste toner container has not been installed, or has been improperly installed, and a condition where with waste toner container is full of waste toner. In addition to the deficiencies in this design noted in Tsuruoka '561, the light interception plate descends vertically from a horizontally sliding closure member positioned between an auger conveying the waste toner and a top port of the waste toner container. I have also noticed that in designs based upon Shimura '484, either failure of the spring used to position the light interception plate or deposit, whether through scattering or gradual accumulation, of only a small amount of waste toner into the guide channel formed in the bottom of the auger's outer casing for reciprocal movement of the closure member, would hinder correct positioning of the closure member and its vertically descending light interception plate; consequently, either a false indication that the waste toner container is full, a false indication that the waste toner is empty or a false indication of an absent container would be generated, with concomitant undesired effects upon the disposition of the waste toner. Furthermore, beside contributing to unreliability of the finished end unit product and creating a serious risk of malfunction due to introduction of waste toner into the interior of the end unit product during the malfunction, the reliance upon mechanical actuation of the light interception plate contributes to unnecessary cost of manufacture and assembly of the end unit product.

Consequently, in order to avoid the risks noted above, contemporary designs of electrophotographic reproduction systems require that a system be provided with both a photosensor and a mechanical contact sensor for sensing whether a waste toner receptacle is installed and whether or not the waste toner receptacle is in a full state. Accordingly, the cost of each end unit product becomes higher and the structural dimensions of the end unit product become larger due to the space occupied by both photosensor and the mechanical contact sensor.

SUMMARY OF THE INVENTION

Therefore, it is one object of the present invention is to provide an improved process and apparatus for concurrently sensing the presence of a waste toner receptacle and whether the receptacle is full of waste toner.

It is another object to provide a reproduction process and apparatus for simultaneously sensing whether or not a waste toner is in a full state and a waste toner box is installed, by using a photosensor.

It is still another object to provide a process and apparatus using a single photosensor to detect both the presence, or absence, of a waste toner receptacle, and the presence of sufficient waste toner to fill the receptacle.

It is yet another object to provide a reproduction process and apparatus able to use an single light emitter and light receiver pair to concurrently sense the presence or absence of a waste toner receptacle and whether the receptacle is or is not full of waste toner.

It is still yet another object to provide a reproduction process and apparatus able to sense both the presence or absence of a waste toner receptacle and whether the receptacle is or is not full of waste toner, without reliance upon physical displacement or movement of any part of the apparatus due to either the presence or absence of the receptacle or the presence of waste toner within the receptacle.

It is a further object to provide a simpler, less expensive, and more reliable reproduction process and apparatus for detecting the presence or absence of a waste toner receptacle and the presence of waste toner filling the receptacle.

It is still a further object to provide a simpler reproduction process and apparatus able to readily distinguish between the absence of a waste toner receptacle and a waste toner receptacle full of toner.

It is yet a further object to provide a simpler reproduction process and apparatus enabling a single sensor to reliably distinguish between conditions where no waste toner receptacle has been installed, where a waste tone receptacle has been installed but is less than full of waste toner, and where a waste toner receptacle has been installed and is full of waste toner.

It is still yet a further object to provide a simpler reproduction process and apparatus enabling display of a visual representation a waste toner receptacle has not been installed that is visually readily distinguishable from visual representations that provided by the process and apparatus that a waste toner receptacle has been installed but is less than full and that a waste toner receptacle has been installed and is full of waste toner.

It is also an object to provide a simpler reproduction process and apparatus able to detect and distinguish between the absence of a waste toner receptacle and the presence of a waste toner receptacle full of waste toner.

These and other objects may be achieved according to the principles of the present invention with a single photosensor positioned in a path of electromagnetic transmission to be interrupted by only a waste toner receptacle and the contents of the receptacle and providing a signal exhibiting a voltage value to a controller. The controller responds to the signal by displaying an indication that a waste toner receptacle is in a full state when the voltage value sensed from a photosensor is higher than a first reference value m, displaying an indication that a waste toner receptacle is not installed when the voltage value sensed from the photosensor is lower than the first reference value m and lower than a second reference value n, and displaying an indication of a normal state of the waste toner receptacle when the voltage value sensed from the photosensor is lower than the first reference value m but greater than the second reference value n.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT

To store the waste toner in the waste toner receptacle, it is necessary to sense whether or not the waste toner receptacle is installed and the waste toner is in a full state. Further, when the waste toner stored in the waste toner receptacle is over a given amount, the receptacle should be removed from the end unit product and the waste toner within the receptacle therein emptied.

Figure 1:
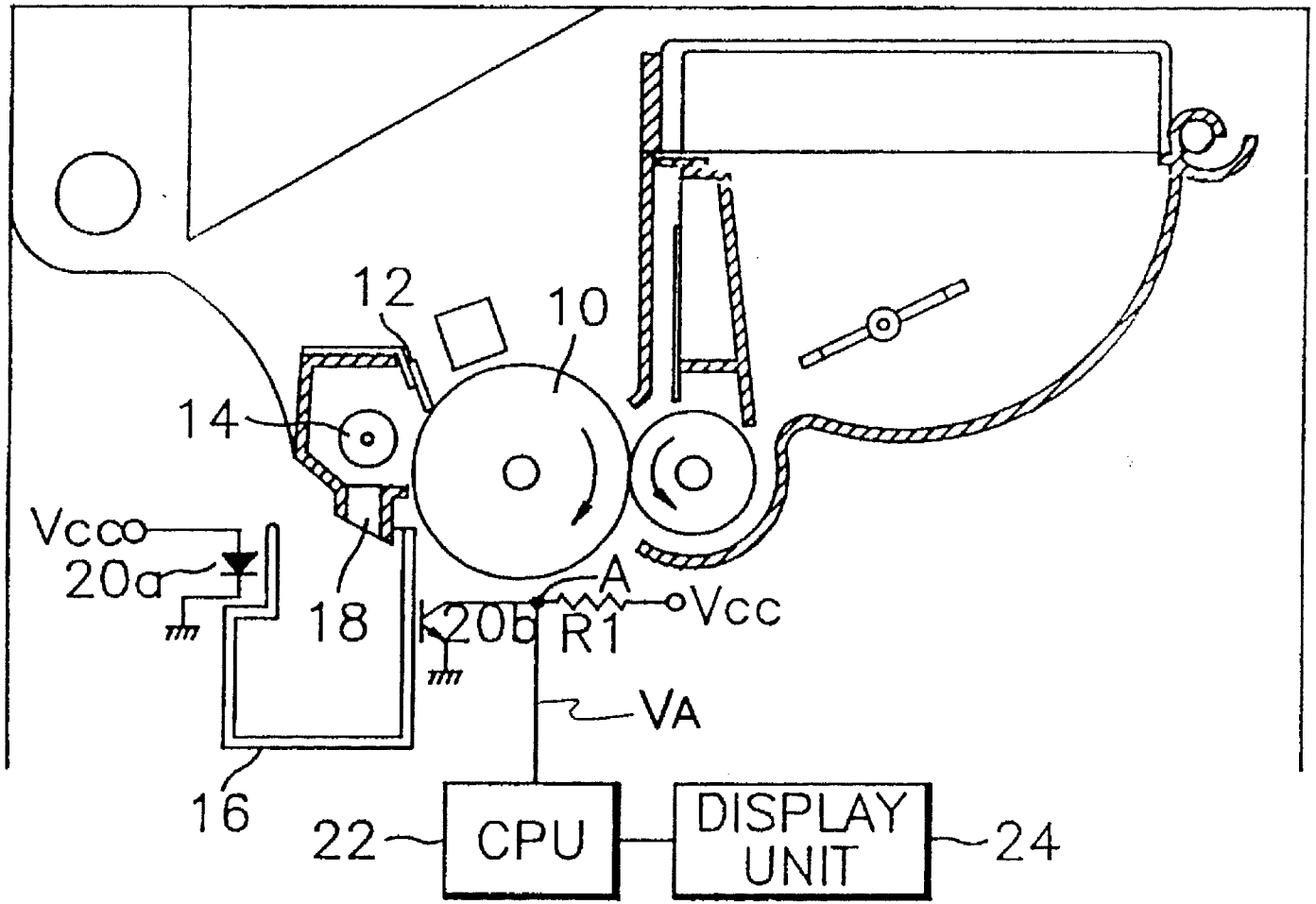
FIG. 1 is a block diagram showing a construction of an electrophotographic reproduction apparatus using an electrophotographic reproduction process according to the principles of the present invention.

Turning now to the drawings, FIG. 1 is a block diagram showing a construction of a system using an electrophotographic developing process performed according to the principles of the present invention. In the construction, the system includes a photosensitive drum 10, a cleaning blade 12 for removing any residual toner on the photosensitive drum 10, an auger 14 for transferring the toner removed by the cleaning blade 12, a waste toner box 16 being made up of a semi-transparent body for storing waste toner, a path 18 for passing the waste toner transferred by auger 14 into waste toner receptacle 16 by the mass of the toner itself (i.e., under influence of gravity upon the mass), a photosensor 20 for outputting a signal $V_A$ sensing whether the waste toner stored in waste toner receptacle 16 is full of waste toner and whether waste toner receptacle 16 is installed, in which a light emitting diode 20*a* and a light receiving transistor 20*b* are respectively installed on opposite sides of a translucent, or light permeable portion of receptacle 16 providing a path accommodating transmission of light, or other electromagnetic radiation, with diode 20*a* and transistor 20*b* facing in opposite directions and facing each other, and facing the translucent portion of waste toner receptacle 16, to sense whether waste toner receptacle 16 is installed and whether that receptacle is full of the waste toner. A central processing unit CPU receives signal $V_A$ from photosensor 20, determines a state of waste toner receptacle 16, and generates a control signal corresponding to respective states. A display unit 24 displays an indication of the presence or absence of waste toner receptacle 16, a different indication of whether receptacle 16 is full of waste toner, or a third indication representing that receptacle 16 has been properly installed and is not full of waste toner, in response to the control signal from CPU 22. Here, display unit 24 may be embodied by a light emitting diode, a liquid crystal diode, or other emitter and sensor of electromagnetic energy.

Figure 2:
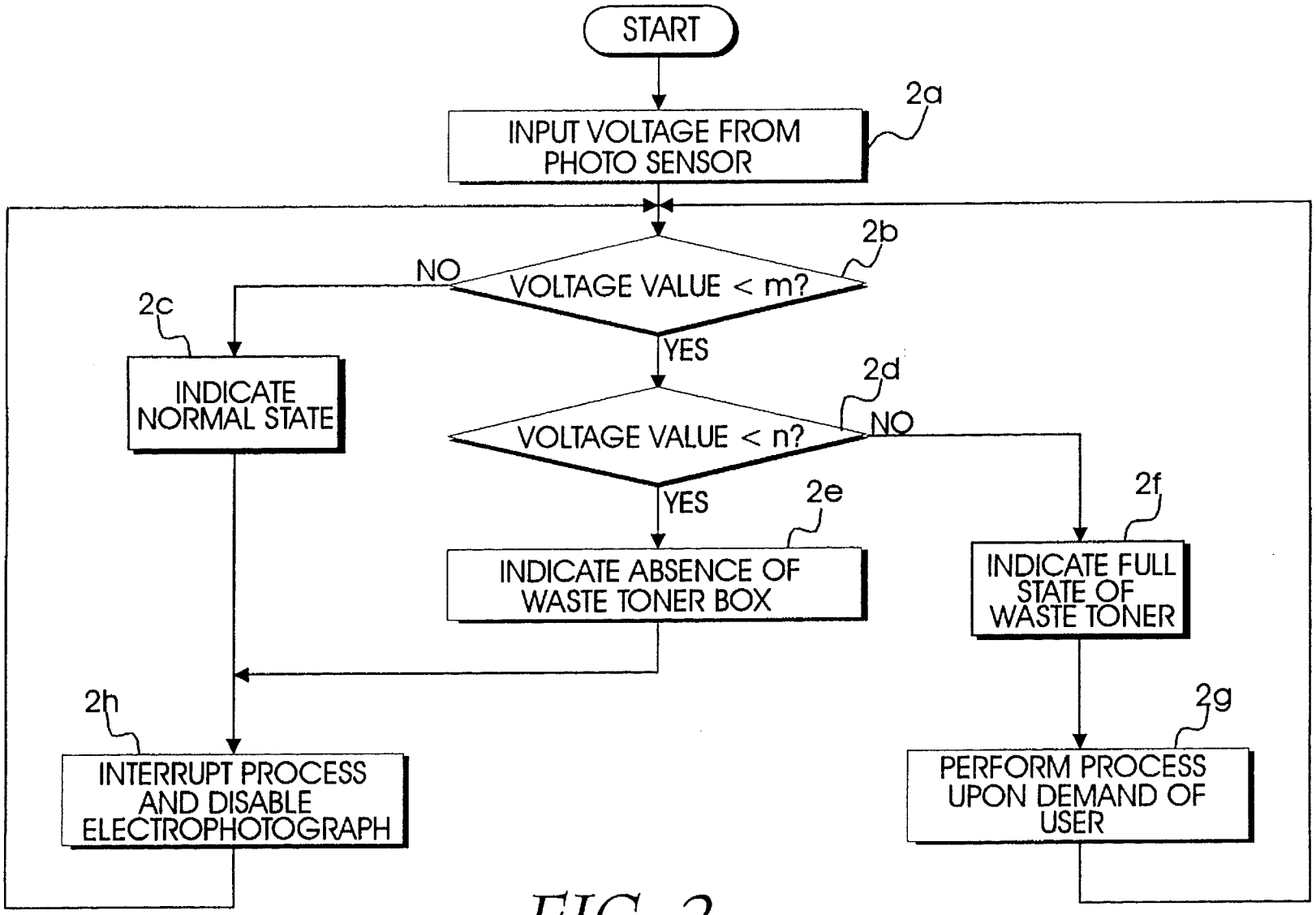
FIG. 2 is a control flow chart for sensing according to the principles of the present invention whether a waste toner is full and whether a waste toner receptacle is installed.

FIG. 2 is a control flow chart of a process for sensing whether a waste toner receptacle is installed and whether the waste toner receptacle is full. The process results in displaying an indication that the waste toner receptacle is full when the voltage value $V_A$ sensed from the photosensor is higher than a first reference value m, displaying an indication that the waste toner receptacle is not installed when the voltage value $V_A$ sensed from a photosensor is lower than a second reference value n, and displaying an indication of a normal state of the waste toner receptacle when the voltage value $V_A$ sensed from the photosensor is lower than the first reference value m but higher than the second reference value n.

Figure 3:
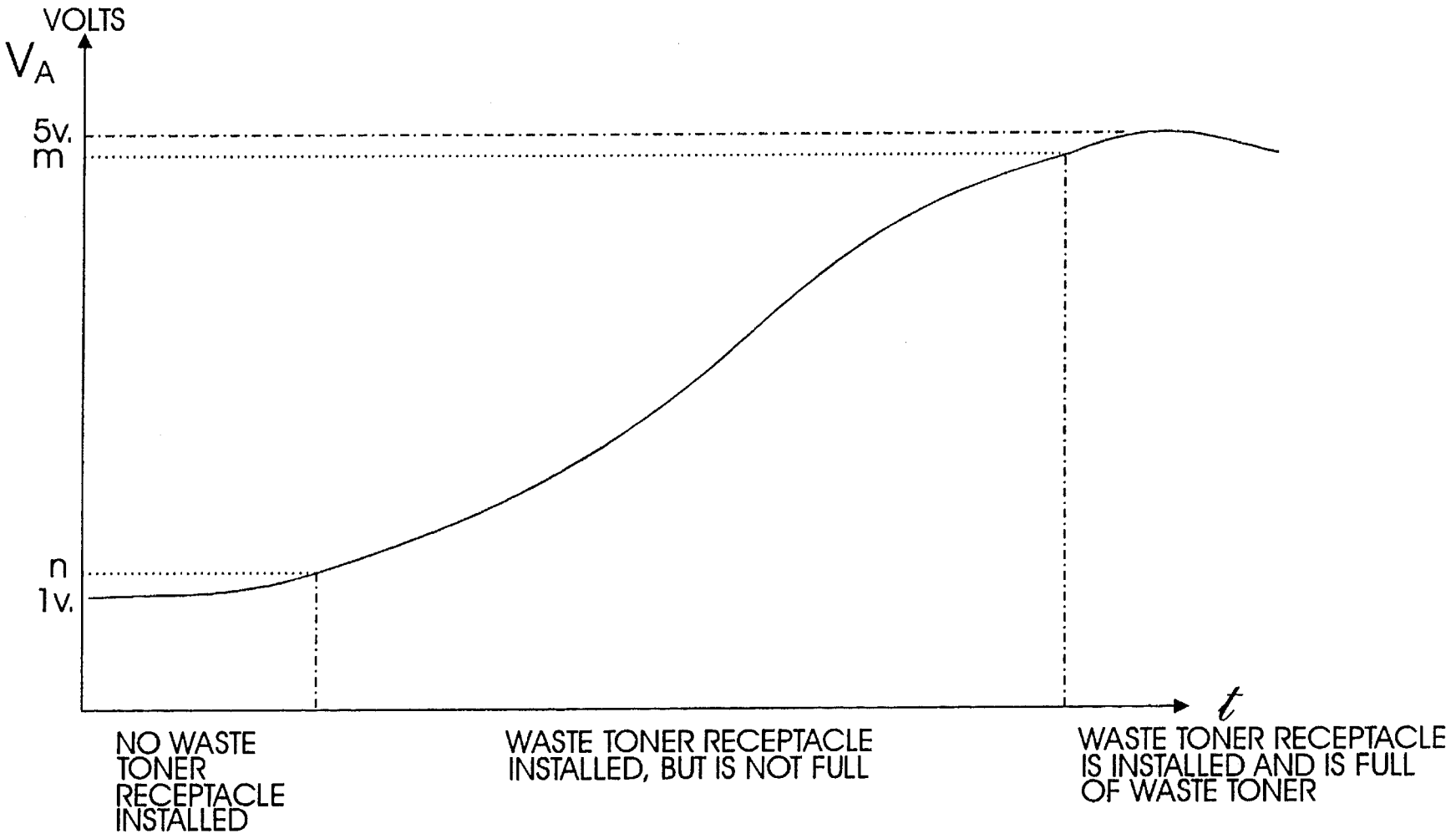
FIG. 3 is a two coordinate graph illustrating a voltage value generated by the photosensor as a function of the varying conditions attributable to the waste toner receptacle.

Now, a preferred embodiment of the present invention will be explained in detail with reference to FIGS. 1, 2 and 3. Photosensor 20 generates a signal sensing whether or not the waste toner stored in waste toner receptacle 16 has filled the receptacle and whether or not that waste toner receptacle 16 has been installed. In this case, a power supply voltage V cc of 5 volts is respectively applied to the light emitting diode 20*a* and the light receiving transistor 20*b* of the photosensor 20. Whether or not the waste toner stored in the waste toner receptacle 16 is in a full state and waste toner receptacle 16 is installed are sensed by the first reference value m and the second reference value n sensed, where the former value m of voltage $V_A$ is higher than the latter value n of voltage $V_A$.

In case that the waste toner is full of waste toner under the condition that the waste toner receptacle 16 is installed, the light from the light emitting diode 20*a* is transmitted to the light receiving transistor 20*b*, thereby rendering the light receiving transistor 20*b* non-conductive. At this time, a voltage level of voltage $V_A$ at node A becomes 5 volts, which is higher than the first reference value m and is then applied to CPU 22. Here, CPU 22 converts the voltage of 5 volts to a digital signal by an internal digital/analog convertor and recognizes the digital signal as an indication of the fact that the waste toner receptacle is full of waste toner. Thereafter, CPU 22 outputs a control signal to display unit 24 to display an indication that the waste toner receptacle is full of waste toner.

In case that waste toner receptacle 16 is not installed, the light from the light emitting diode 20*a* is directly transmitted to the light receiving transistor 20*b*, since the light does not pass through waste toner receptacle 16, thereby rendering light receiving transistor 20*b* conductive. In this time, since a voltage drop level of the light receiving transistor 20*b* is 1 volt, a voltage level of voltage $V_A$ at node A becomes a minimum level of 1 volt, which is lower than the first reference value m and the second reference value n and is then applied to CPU 22. Here, CPU 22 converts the voltage $V_A$ of 1 volt into a digital signal by the internal digital/analog convertor and recognizes the digital signal as representing the fact that the waste toner box 16 is not installed. Thereafter, CPU 22 outputs a control signal to display unit 24 to display indication of an absence of waste toner receptacle 16. Here, indication that the waste toner is in a full state and that waste toner receptacle 16 has not been installed is inconsistent and is considered as a kind of error message. In this case, if necessary, CPU 22 stops operation of the system.

In case that the waste toner receptacle is not full of waste toner under the condition that waste toner receptacle 16 is installed, the light from light emitting diode 20*a* is indirectly transmitted to light receiving transistor 20*b* after passing through waste toner receptacle 16. In this case, since an electric current flowing through light receiving transistor 20*b* becomes weaker due to the opaqueness or semi-transparency of the portion of receptacle 16 providing the path of light transmission than the current flowing during the state when waste toner receptacle 16 is not installed, a voltage level of voltage $V_A$ on node A is at an intermediate level of:

$$1\ V<V_A<5\ V \quad (1)$$

which is lower than the first reference value m but higher than the second reference value n, and is then applied to CPU 22. As shown in FIG. 3, the value of the intermediate voltage level varies due to causes as, for example, scattering of newly introduced waste toner clouding the path of light transmission through receptacle 16. Here, CPU 22 converts the intermediate voltage level of $V_A$ lower than the first reference value m but higher than the second reference value n into a digital signal by the internal digital/analog convertor and recognizes the digital signal as the fact that waste toner receptacle 16 is installed and the waste toner accumulation in receptacle 16 is in a normal state. Thereafter, CPU 22 does not display a separate message and proceeds to a normal printing operation. If it is desired to display a specific message however, CPU 22 outputs a control signal to display unit 24 to display indication of a normal state of the waste toner accumulation.

In this case, a voltage $V_A$ at node A may have some variation in dependence on an external condition. Therefore, to compensate for the variation, a voltage level of 4 volts may be set to the first reference value m and a voltage level of 1.5 volts may be set to the second reference value n.

CPU 22 receiving the voltage applied from photosensor 20 determines the state of the waste toner receptacle 16, depending upon the received voltage $V_A$ and outputs a control signal corresponding to the respective states, so that CPU 22 displays a visual indication of the presence or absence of waste toner receptacle 16, an indication of whether the receptacle is full of waste toner, or a normal state of the waste toner accumulation within the receptacle, on the visual display unit, or stops operation of the system. Further, CPU 22 receiving voltage $V_A$ applied from photosensor 20 determines the state of waste toner receptacle 16, depending upon the received voltage $V_A$ and outputs a control signal corresponding to respective states, so that CPU 22 selects a display of a visual indication of the presence or absence of waste toner receptacle 16, that receptacle 16 is full of waste toner, or that a normal state representing that receptacle 16 is present and that receptacle 16 is less than full of waste toner, on display unit 24. CPU 22 is able to stop operation of the system when the value of voltage $V_A$ indicates either the absence of receptacle 16 or that receptacle 16 is full of waste toner.

Such an operation as mentioned above will be hereinafter explained with reference to FIG. 2. First, CPU 22 receives the voltage applied from the photosensor 20 at step 2*a* and proceeds to step 2*b*. At the step 2*b*, CPU 22 determines whether the received voltage value $V_A$ is lower than the first reference value m of 4 volts. Here, if the received voltage value $V_A$ is higher than the first reference value m, CPU 22 proceeds to step 2*c* and generates a control signal corresponding to a full state of the waste toner, thereby displaying the full state of the waste toner on the display unit 24. At the step 2*b*, however, if the received voltage value $V_A$ is lower than the first reference value of m, CPU 22 proceeds to step 2*d*. At step 2*d*, CPU 22 determines whether the received voltage value $V_A$ is lower than the second reference value n. Here, if the received voltage value $V_A$, is higher than the second reference value n, CPU 22 proceeds to step 2*f* and generates a control signal corresponding to a normal state of the waste toner, thereby displaying a representation that the receptacle is in a normal state on the display unit 24. Then, the process is able to proceed to step 2*g* and, upon demand by a user, perform the reproduction process. Here, since waste toner box 16 has a semi-transparent, or translucent body, the output voltage $V_A$ of photosensor 20 in the condition that the waste toner receptacle is not full is lower in value than the first reference value m and higher in value than the second reference value n. Also, at step 2*d*, if photosensor voltage $V_A$ received from photosensor 20 is lower than the second reference value n, CPU 22 proceeds to step 2*e* and generates a control signal corresponding to an absence of waste toner receptacle 16, thereby triggering display of an indication of the absence of waste toner receptacle 16 on the display unit 24. Subsequent to steps 2*c* and 2*e*, the process proceeds to step 2*h* and interrupts, or temporarily disables the electrophotographic reproduction apparatus.

In an embodiment of the present invention, for the convenience of explanation, the first reference value m is higher than the second reference value n, but if the output of photosensor 20 is inverted and is supplied to the CPU 22, the first reference value m becomes lower than the second reference value n. Accordingly, even in an alternative embodiment where the first reference value m becomes lower than the second reference value n, the preferred embodiment of the invention can be embodied without departing from the scope of the present invention.

As discussed above, there is provided an apparatus and method capable of sensing whether or not a waste toner receptacle is full and whether the waste toner receptacle is installed, by using a single photosensor, so that a user is able to easily concurrently determine whether or not the waste toner receptacle is installed and whether the receptacle is full of waste toner and therefore, the structure of an end unit product constructed according the principles of the present invention is more compact, is more reliable due to fewer parts liable to malfunction, and has a lower cost of manufacture and assembly.

What is claimed is:

1. An apparatus for sensing states of a waste toner box and a waste toner contained therein in an electrophotographic reproducing apparatus, said apparatus comprising:

a waste toner box having a semi-transparent body for storing waste toner removed from a cleaning element within the apparatus;

photosensing means for providing a signal indicating whether or not the waste toner stored in said waste toner box is in a full state and whether said waste toner box is installed between a light emitting unit and a light receiving unit that are respectively installed in a direction opposite to each other, facing said waste toner box, to sense whether or not the waste toner box is in the full state;

control means for receiving the signal from said photosensing means, determining presence and absence of said waste toner box and the full state of the waste toner box, and generating respective control signals corresponding to said states of said waste toner box and the waste toner contained therein; and displaying means for displaying representations of the presence and absence of said waste toner box, the full state of the waste toner box and a normal state of the waste toner box by the respective control signals of said control means.

2. The apparatus of claim 1, wherein said respective control signals generated from said control means stop an operation of the system when determining the absence of said waste toner box and the full state of the waste toner.

3. The apparatus of claim 1, comprising said light emitting unit emitting a beam of electromagnetic radiation substantially attenuated upon transmission through said waste toner box.

4. A method for sensing states of a waste toner box and a waste toner contained therein in an electrophotographic reproduction apparatus having a photosensor for outputting a signal sensing whether or not a waste toner is in a full state and said waste toner box is installed, said method comprising the steps of:

generating a control signal corresponding to a full state of the waste toner, when a voltage value sensed from said photosensor is higher than a first reference value;

generating a control signal corresponding to an absence of said waste toner box, when the voltage value sensed from said photosensor is lower than a second reference value; and generating a control signal corresponding to a normal state of the waste toner, when the voltage value sensed from said photosensor is lower than said first reference value but higher than said second reference value.

5. An apparatus for sensing status of a waste toner receptacle in an electrophotographic reproduction process, comprising:

receptacle means for occupying a volume within an electrophotographic developer during said reproduction process and for providing a translucent path exhibiting a variable degree of accommodation for passage of electromagnetic radiation, and for storing within said path residual toner received from the reproduction process;

photosensing means for illuminating said path by emission of electromagnetic radiation, and for generating a signal varying in dependence upon said degree of accommodation of said passage across said path by said electromagnetic radiation during said emission; and means for responding to said signal by controlling, in dependence upon said degree of accommodation represented by said signal, a visual display to communicate a first message representing an absence of said receptacle means within said volume and a second and different message representing that said receptacle means is substantially full of said residual toner.

6. The apparatus of claim 5, comprising said controlling means for interrupting said electrophotographic process in response to said signal exhibiting a value corresponding to said absence of said receptacle means within said volume, and for interrupting said reproduction process in response to said signal exhibiting a value corresponding to said receptacle means being substantially full of said residual toner.

7. The apparatus of claim 6, comprised of said signal:

exhibiting a first state representing that said receptacle means has not been installed within said volume;

exhibiting a second state different from said first state, representing that said receptacle means is present within said volume and is not full of said residual toner; and exhibiting a third state different from said first state and from said second state, representing that said receptacle means is present within said volume and is full of said residual toner.

8. The apparatus of claim 6, comprising said photosensing means:

generating said signal with a value less than a first reference value when said receptacle means is not within said volume; and generating said signal with a value greater than a second reference value different from said first reference value when said receptacle means is within said volume and said receptacle means is full of said toner.

9. The apparatus of claim 6, comprised of said photosensing means comprising a single photoemitting diode separated by said path from a single photosensitive transistor.

10. The apparatus of claim 5, comprised of said path disposed to be obstructed by only said receptacle means and residual toner within said receptacle means.

11. The apparatus of claim 10, comprised of said signal:

exhibiting a first state representing that said receptacle means has not been installed within said volume;

exhibiting a second state different from said first state and representing that said receptacle means is present within said volume and is not full of said residual toner; and exhibiting a third state different from said first state and from said second state and representing that said receptacle means is present within said volume and is full of said residual toner.

12. The apparatus of claim 10, comprising said photosensing means:

generating said signal with a value less than a first reference value when said receptacle means is not within said volume; and generating said signal with a value greater than a second reference value different from said first reference value when said receptacle means is within said volume and said receptacle means is full of said toner.

13. The apparatus of claim 10, comprised of said photosensing means comprising a single photoemitting diode separated by said path from a single photosensitive transistor.

14. The apparatus of claim 5, comprised of said signal:

exhibiting a first state representing that said receptacle means has not been installed within said volume; and exhibiting a second state different from said first state, representing that said receptacle means is present within said volume and is not full of said residual toner.

15. The apparatus of claim 14, comprising said photosensing means:

generating said signal with a value less than a first reference value when said receptacle means is not within said volume; and generating said signal with a value greater than a second reference value different from said first reference value when said receptacle means is within said volume and said receptacle means is full of said toner.

16. The apparatus of claim 14, comprised of said photosensing means comprising a single photoemitting diode separated by said path from a single photosensitive transistor.

17. The apparatus of claim 5, comprised of said signal:

exhibiting a first state representing that said receptacle means has not been installed within said volume;

exhibiting a second state different from said first state, representing that said receptacle means is present within said volume and is not full of said residual toner; and exhibiting a third state different from said first state and from said second state, representing that said receptacle means is present within said volume and is full of said residual toner.

18. The apparatus of claim 17, comprised of said photosensing means comprising a single photoemitting diode separated by said path from a single photosensitive transistor.

19. The apparatus of claim 5, comprising said photosensing means:

generating said signal with a value less than a first reference value when said receptacle means is not within said volume; and generating said signal with a value greater than a second reference value different from said first reference value when said receptacle means is within said volume and said receptacle means is full of said toner.

20. The method as claimed in claim 19, wherein said first reference value is lower in value than said second reference value.

21. The apparatus of claim 5, comprised of said photosensing means comprising a single photoemitting diode separated by said path from a single photosensitive transistor.

22. An apparatus for sensing and displaying the status of a receptacle in an electrophotographic reproduction apparatus, comprising:

a semitransparent receptacle providing a path exhibiting a characteristic varying in dependence upon whether said receptacle is present within the electrophotographic reproduction apparatus and whether waste toner is present within said receptacle;

photosensing means for illuminating said path by emission of electromagnetic radiation, and for generating a signal simultaneously indicating whether said receptacle is present within said path, and whether said receptacle is full of waste toner; and means for responding to said signal by generating a visual display communicating whether said receptacle is present within the electrophotographic reproduction apparatus and whether said receptacle is full of waste toner.

23. The apparatus of claim 3, comprising said light receiving unit converting said beam of electromagnetic radiation into a current having a magnitude that is a function of intensity of said electromagnetic radiation received by said light receiving unit via said waste toner box.

24. An apparatus for sensing and displaying the status of a receptacle in an electrophotographic reproduction apparatus, comprising:

a semitransparent receptacle providing a path exhibiting a characteristic varying in dependence upon whether said receptacle is present within the electrophotographic reproduction apparatus and of waste toner within said receptacle;

photosensing means for illuminating said path by emission of electromagnetic radiation, and for generating a signal simultaneously indicating whether said receptacle is present within said path, whether said receptacle is present within the electrophotographic reproduction apparatus and is not full of toner, and whether said receptacle is full of waste toner; and means for responding to said signal by generating a visual display communicating whether said receptacle is present within the electrophotographic reproduction apparatus, whether said receptacle is present within the electrophotographic reproduction apparatus and is not full of waste toner, and whether said receptacle is full of waste toner.

* * * * *